US005831383A

United States Patent [19]

Pack et al.

[11] Patent Number: 5,831,383

[45] Date of Patent: Nov. 3, 1998

[54] SPACER PADS FOR FIELD EMISSION DEVICE

[75] Inventors: Sung P. Pack, Tempe; Rodolfo Lucero, Scottsdale; Chenggang Xie, Phoenix; Johann Trujillo, Mesa; Rob Rumbaugh, Scottsdale, all of Ariz.

[73] Assignee: Motorola Inc., Schaumburg, Ill.

[21] Appl. No.: 854,861

[22] Filed: May 12, 1997

[51] Int. Cl.[6] ..... H01J 1/96

[52] U.S. Cl. ..... 313/495; 313/309

[58] Field of Search ..... 313/495, 496, 313/497, 309, 336, 352, 422

[56] References Cited

U.S. PATENT DOCUMENTS 5,514,847 5/1996 Makishima et al. ..... 313/309
5,561,343 10/1996 Lowe ..... 313/496
5,614,781 3/1997 Spirdt et al. ..... 313/422
5,675,212 10/1997 Schmidt et al. ..... 313/422

*Primary Examiner*—Sandra L. O'Shea
*Assistant Examiner*—Michael Day
*Attorney, Agent, or Firm*—Jasper W. Dockrey; Kathleen A. Tobin

[57] ABSTRACT

A field emission device (100, 200) includes an anode (190); a substrate (110); a plurality of spaced apart cathodes (120); a dielectric layer (124) disposed on the cathodes (120); a plurality of spacer pads (130, 230) disposed on the substrate (110) between adjacent cathodes (120) and including a spacer contact layer (142, 185) that defines the surfaces of the spacer pads (130, 230); a spacer (150) having a first edge (157), a second edge (155), and a conductive layer (152) disposed on the second edge (155), the first edge (157) contacting the anode (190), the conductive layer (152) contacting the spacer contact layer (142, 185) at the spacer pads (130, 230); and an electron emitter (170) disposed within the dielectric layer (124) and spaced apart from the second edge (155) of the spacer (150).

15 Claims, 6 Drawing Sheets

SPACER PADS FOR FIELD EMISSION DEVICE

FIELD OF THE INVENTION

The present invention pertains to the area of field emission device and, more particularly, to structural spacers for field emission devices.

BACKGROUND OF THE INVENTION

Structural spacers for field emission devices are known in the art. Spacers are used to prevent the collapse of the opposing plates of the device due to the vacuum conditions between them. One of these opposing plates includes a cathode plate, which has field emitters, a gate extraction electrode, and a cathode electrode.

In one prior art scheme for providing spacers for field emission devices, glass members are affixed to one of the opposing plates. Thereafter, the remaining opposing plate is placed on the spacers. Other packaging elements, such as a frame, are provided to create an evacuateable region. When the evacuateable region is evacuated, the opposing plates are forced against the spacers by atmospheric pressure. This prior art scheme suffers from the disadvantage that it does not protect the conductive lines of the device cathode from physical damage and electrical shorting shorting when the spacers press onto the inner surface of the cathode plate.

Accordingly, there exists a need for an improved field emission device having conductive lines which are protected from damage and shorting due to pressure exerted by structural spacers.

Figure 1:
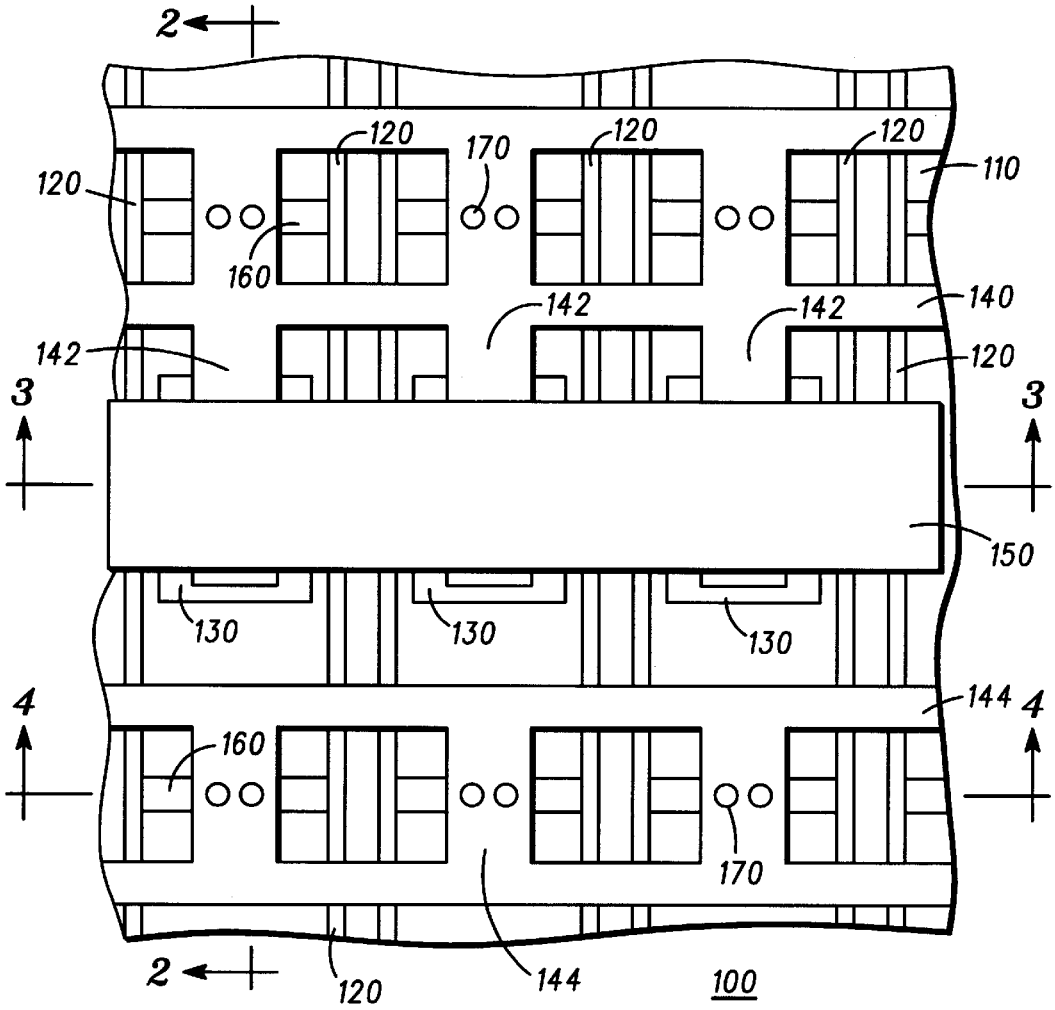
FIG. 1 is a top plan view of a first embodiment of a field device in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

The invention is for a field emission device having a cathode structure that is spaced apart from the edge of a spacer at the locations of the cathodes. This configuration prevents the edge of the spacer from making physical or electrical contact during the evacuation of the package. Thus, damage to the cathodes and electrical shorting between cathodes is reduced.

FIG. 1 is a top plan view of a field emission device 100 in accordance with the invention. Field emission device 100 includes a substrate 110. Substrate 110 is made from a solid dielectric material, such as a plate of glass. Formed on substrate 110 are a plurality of cathodes 120. Cathodes 120 include layers of a conductive material, such as molybdenum, aluminum, and the like. Cathodes 120 are designed to be connected to a potential source (not shown) for applying a predetermined potential thereto.

Field emission device 100 further includes a dielectric layer (not shown) that is formed by a convenient deposition technique onto cathodes 120. Field emission device 100 also includes a plurality of electron emitters 170 that are disposed proximate to cathodes 120. In the embodiment of FIG. 1 electron emitters 170 include conical emitters, such as Spindt tips.

Field emission device 100 also includes a first gate electrode 140 and a second gate electrode 144, which is parallel to and spaced apart from first gate electrode 140. First and second gate electrodes 140, 144 are made from a conductive material, such as molybdenum, aluminum, and the like, which is deposited and patterned using a convenient deposition and patterning technique. They are designed to be connected to a potential source (not shown) for selectively applying a potential thereto, independent of the potential at cathodes 120. First and second gate electrodes 140, 144 overlap cathodes 120 at right angles. Electron emitters 170 are formed at the overlapping regions, so that electron emitters 170 can be selectively addressed.

First gate electrode 140 includes a plurality of extensions which define a spacer contact layer 142. These extensions of first gate electrode 140 extend into regions between cathodes 120 and define the top layer of a plurality of spacer pads 130, which are described in greater detail with reference to FIG. 2. Spacer pads 130 are spaced apart from cathodes 120 and are electrically isolated therefrom.

Field emission device 100 further includes a spacer 150, which is supported by spacer pads 130. Spacer 150 is made from a dielectric material, such glass, ceramic, and the like. For the purpose of illustration and in no way intended to be limiting, the dimensions of spacer 150 are about 100 micrometers wide, one millimeter tall, and about 5 millimeters long.

Figure 2:
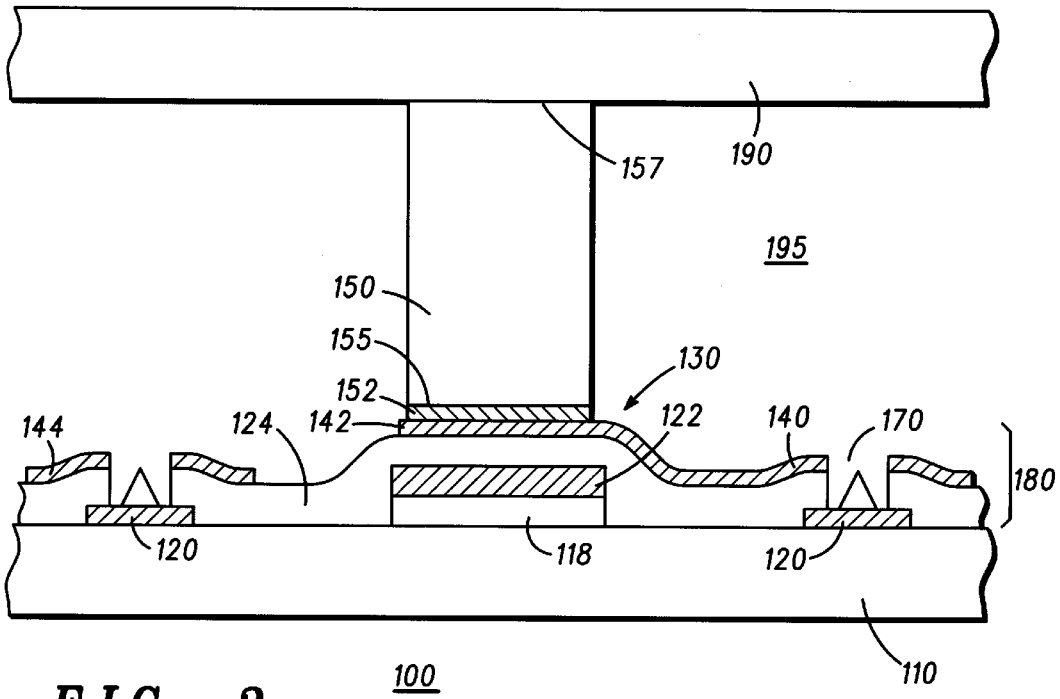
FIG. 2 is a cross-sectional view taken along the section line 2—2 of FIG. 1.

FIG. 2 is a cross-sectional view of field emission device 100 taken along the section line 2—2 of FIG. 1. As illustrated in FIG. 2, field emission device 100 further includes an anode 190, which is designed to receive electrons emitted from electron emitters 170. Electron emitters 170, cathodes 120, a dielectric layer 124, spacer pads 130 and first and second gate electrodes 140, 144 comprise a cathode structure 180. Dielectric layer 124 includes a layer of dielectric material, such as silicon dioxide, silicon nitride, and the like.

Cathode structure 180 is spaced apart from anode 190 by spacer 150 to define an interspace region 195 therebetween. For ease of understanding, only one spacer 150 is illustrated herein. However, a field emission device of the invention includes a sufficient number of spacers 150 to provide mechanical support to prevent collapse of anode 190 and substrate 110.

Spacer 150 includes a first edge 157, which contacts anode 190, and a second edge 155, which has a conductive layer 152 formed thereon. Conductive layer 152 includes a layer of conductive material, such as aluminum, gold, amorphous silicon, doped amorphous silicon, and the like. Conductive layer 152 is placed on spacer contact layer 142 at spacer pads 130. During the operation of field emission device 100, spacer pads 130 are exposed to a sea of electrical charge. Thus, it is beneficial to electrically connect spacer pads 130 to a convenient, stable potential. In the embodiment of FIGS. 1 and 2 this stable potential is provided by first gate electrode 140 through spacer contact layer 142.

In the embodiment of FIG. 2, spacer pads 130 include a ballast pad layer 118, which is disposed on substrate 110, a cathode pad layer 122, which is disposed on ballast pad layer 118, a portion of dielectric layer 124, which is disposed on cathode pad layer 122, and a portion of spacer contact layer 142, which is disposed on the portion of dielectric layer 124.

Figure 3:
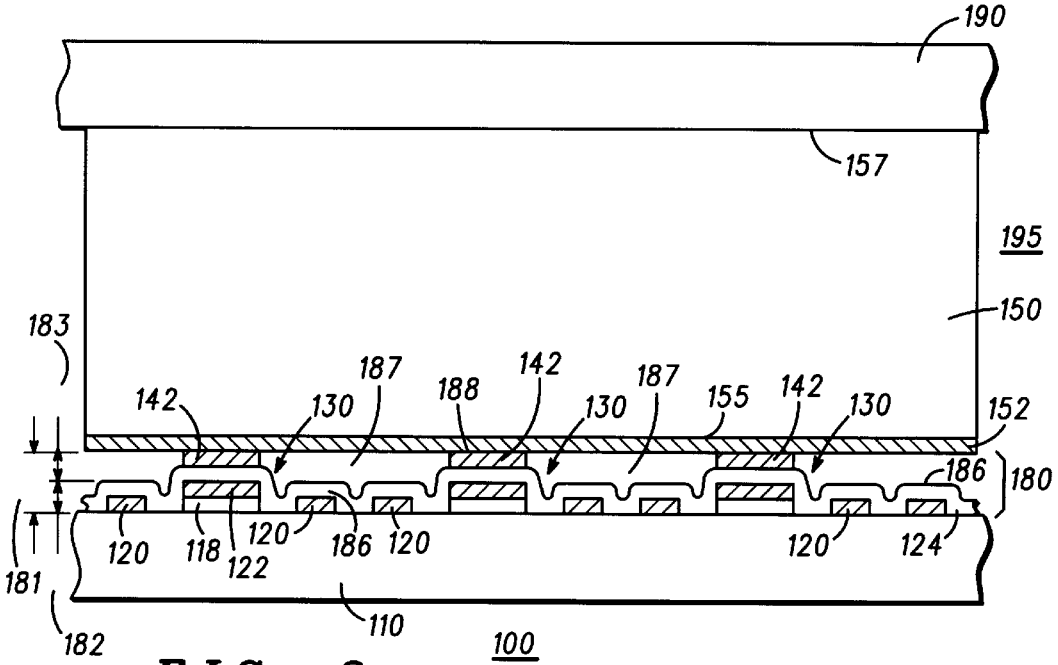
FIG. 3 is a cross-sectional view taken along the section line 3—3 of FIG. 1.

FIG. 3 is a cross-sectional view of field emission device 100 taken along the section line 3—3 of FIG. 1. FIG. 3 further illustrates the electrical isolation of spacer pads 130 from cathodes 120.

Also illustrated in FIG. 3 is a first height 182 of cathode structure 180 $h_c$, which is the height of cathode structure 180 at cathodes 120 along the length of spacer 150. A second height 181 of cathode structure 180 $h_p$ includes the height of cathode structure 180 at spacer pads 130. Second height 181 is greater than first height 182, so that a gap 187 is formed above each of cathodes 120 along the length of spacer 150. In the embodiment of FIG. 3, gaps 187 are defined by conductive layer 152, spacer pads 130, and a first portion 186 of the surface of cathode structure 180, which overlies cathodes 120 along the length of spacer 150. A second portion 188 of the surface of cathode structure 180 is defined by spacer contact layer 142 and is disposed between cathodes 120 at spacer pads 130.

When field emission device 100 is constructed, spacer 150 is positioned between cathode structure 180 and anode 190, and then interspace region 195 is evacuated. Upon evacuation, spacer 150 exerts pressure against cathode structure 180. Gaps 187 prevent second edge 155 of spacer 150 from penetrating through dielectric layer 124 and making contact with cathodes 120. In this manner, shorting between cathodes 120 and damage to cathodes 120 are prevented. A height 183 of gaps 187 $h_g$ is predetermined to prevent this contact and depends upon factors such as the roughness of second edge 155 of spacer 150.

By way of example, and in no way intended to be limiting, in the particular embodiment of FIG. 3, the thickness of ballast pad layer 118 is about 5000 angstroms; the thickness of cathode pad layer 122 is about 3000 angstroms; the thickness of dielectric layer 124 is about 10,000 angstroms; and the thickness of spacer contact layer 142 is about 2000 angstroms. Thus, in this particular example, second height 181 is about 20,000 angstroms, whereas first height 182 is 13,000 angstroms. First height 182 is equal to the sum of the thickness of cathodes 120 and the thickness of dielectric layer 124.

Figure 4:
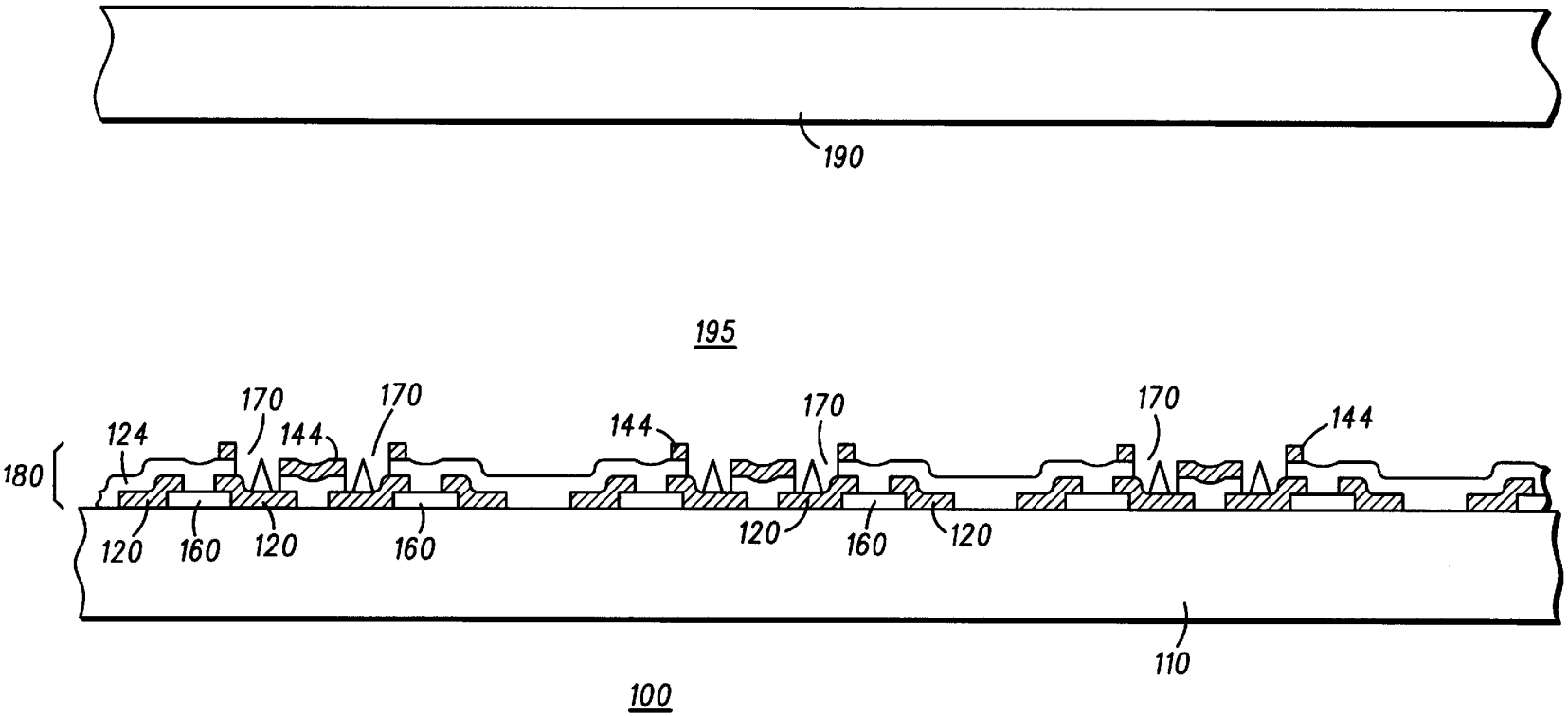
FIG. 4 is a cross-sectional view taken along the section line 4—4 of FIG. 1.

FIG. 4 is a cross-sectional view of field emission device 100 taken along the section line 4—4 of FIG. 1. FIG. 4 illustrates the configuration of cathode structure 180 at electron emitters 170. A ballast resistor 160 is provided between each of electron emitters 170 and the portion of cathodes 120 to which a potential is provided by a potential source (not shown). Ballast resistors 160 are made from a resistive material, such as amorphous silicon, doped amorphous silicon, and the like.

The configuration of FIG. 4 is realized by first forming on substrate 110 ballast resistors 160 using a convenient deposition and patterning method. Thereafter, cathodes 120 are deposited. Then, dielectric layer 124 and first and second gate electrodes 140, 144 are formed. Wells are formed in dielectric layer 124. Electron emitters 170 are then formed in these wells.

During each of the deposition process steps used to form ballast resistors 160, cathodes 120, dielectric layer 124, and first and second gate electrodes 140, 144, the deposition material is simultaneously deposited at the desired locations for spacer pads 130. Ballast pad layer 118 is realized during the formation of ballast resistors 160, and cathode pad layer 122 is realized during the formation of cathodes 120. Thus, in the embodiment of FIG. 3, the thickness of ballast pad layer 118 equals the thickness of ballast resistors 160, and the thickness of cathode pad layer 122 equals the thickness of cathodes 120. The masks used to form ballast resistors 160 and cathodes 120 are defined to deposit material at the desired locations for spacer pads 130. Dielectric layer 124 is deposited as a blanket layer, and first gate electrode 140 is patterned to provide spacer contact layer 142 at spacer pads 130. In this manner, no additional process steps are required to form spacer pads 130; they are formed during the process steps that form the other elements of field emission device 100.

However, the spacer pads of the invention can include other combinations of layers of materials. Also, additional process steps can be included to form the spacer pads, so that additional height and/or different materials can be employed. For example, after the formation of ballast resistors 160, a separate mask may be employed to deposit additional ballast resistor material only at the locations of the spacer pads. In this manner, the height of the spacer pads is increased. A similar technique may be employed during the formation of one or more of the other layers that comprise the spacer pads. Furthermore, another material, distinct from the materials used to form the ballast resistors, the cathodes, the dielectric layer, and the gate electrodes, may be utilized to form one or more of the layers that comprise the spacer pads.

In a further embodiment of the invention the dielectric material is removed at the locations of the spacer pads, so that the layers comprising the spacer pads are electrically coupled. Additionally, a variety of methods can be employed to form the constituent layers of the spacer pads, such as plating, lift-off, shadow-mask deposition, and the like.

An example of a lift-off process includes, prior to the formation of the electron emitters and the gate electrodes, the steps of etching through the dielectric layer at the desired locations of the spacer pads; depositing a lift-off layer by an angled evaporation onto the dielectric surfaces not defining the spacer pad locations; depositing a spacer pad material as a blanket layer; and then removing the lift-off layer, so that the spacer pad material is removed from the top surface of the dielectric layer and only remains at the locations of the spacer pads.

Figure 5:
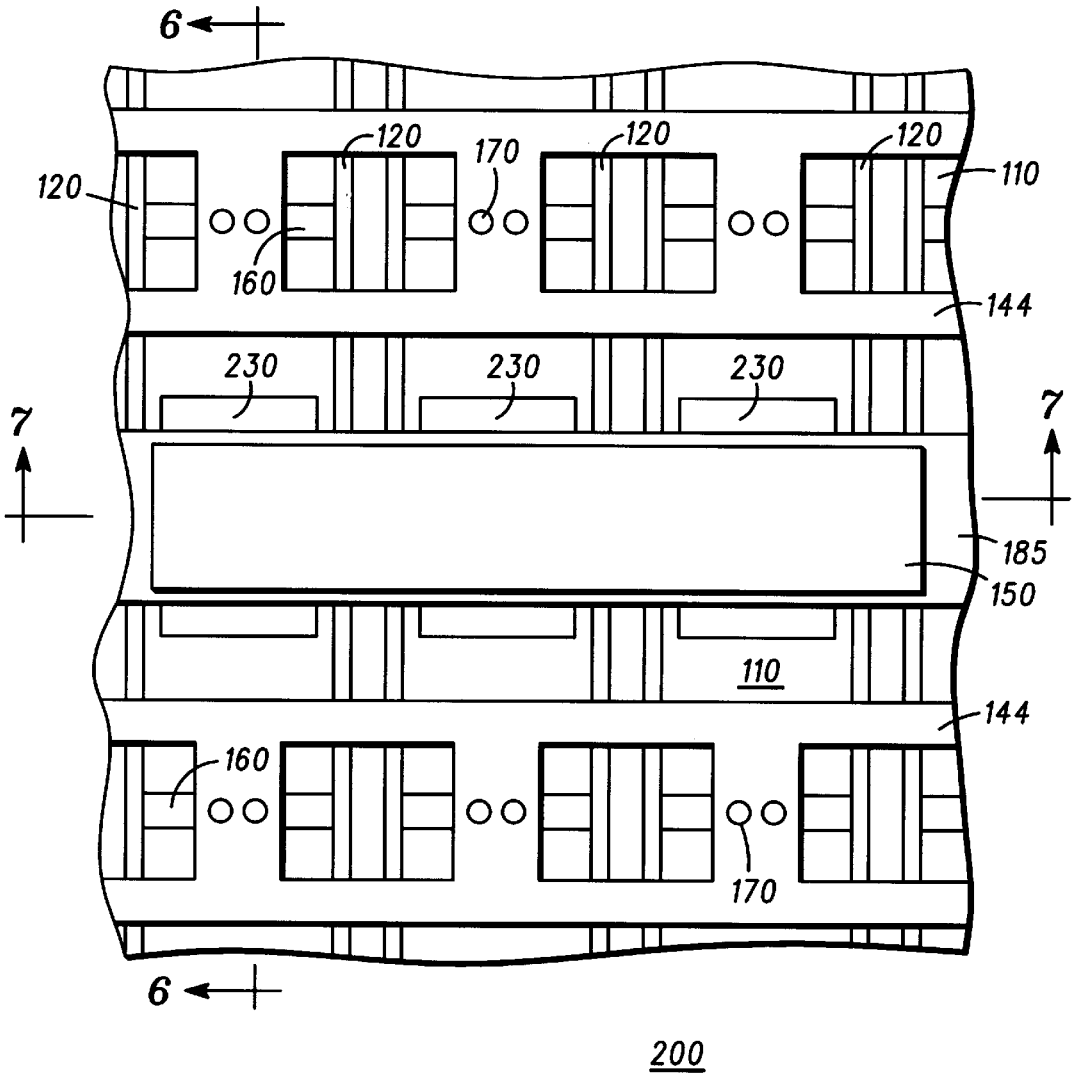
FIG. 5 is a top plan view of a second embodiment of a field emission device in accordance with the invention.
Figure 6:
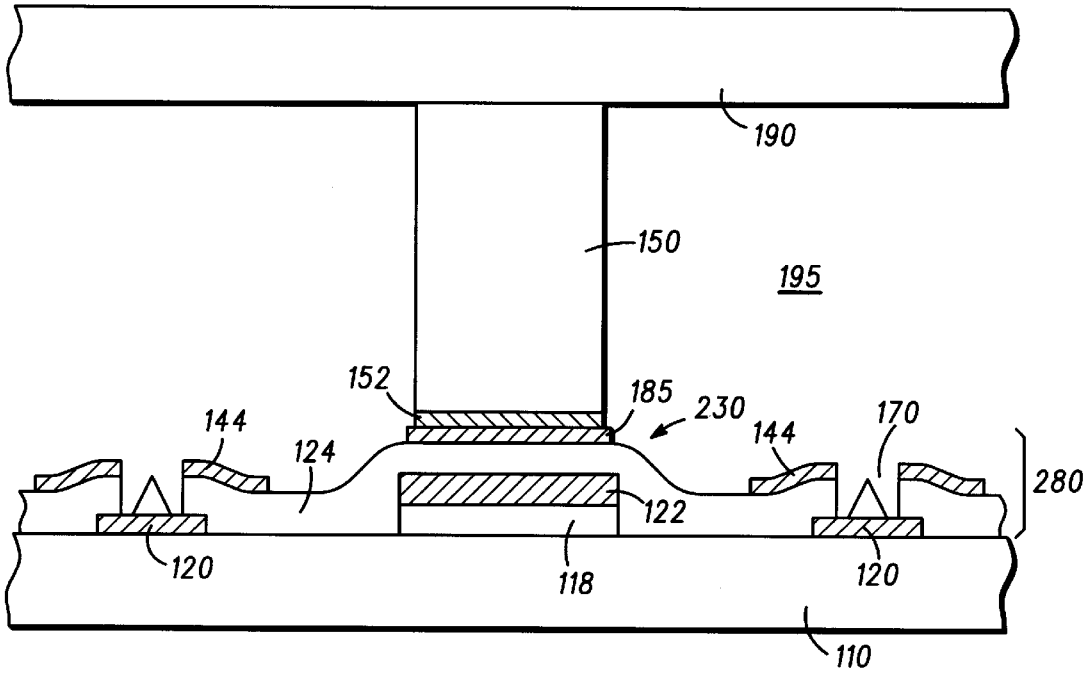
FIG. 6 is a cross-sectional view taken along the section line 6—6 of FIG. 5.
Figure 7:
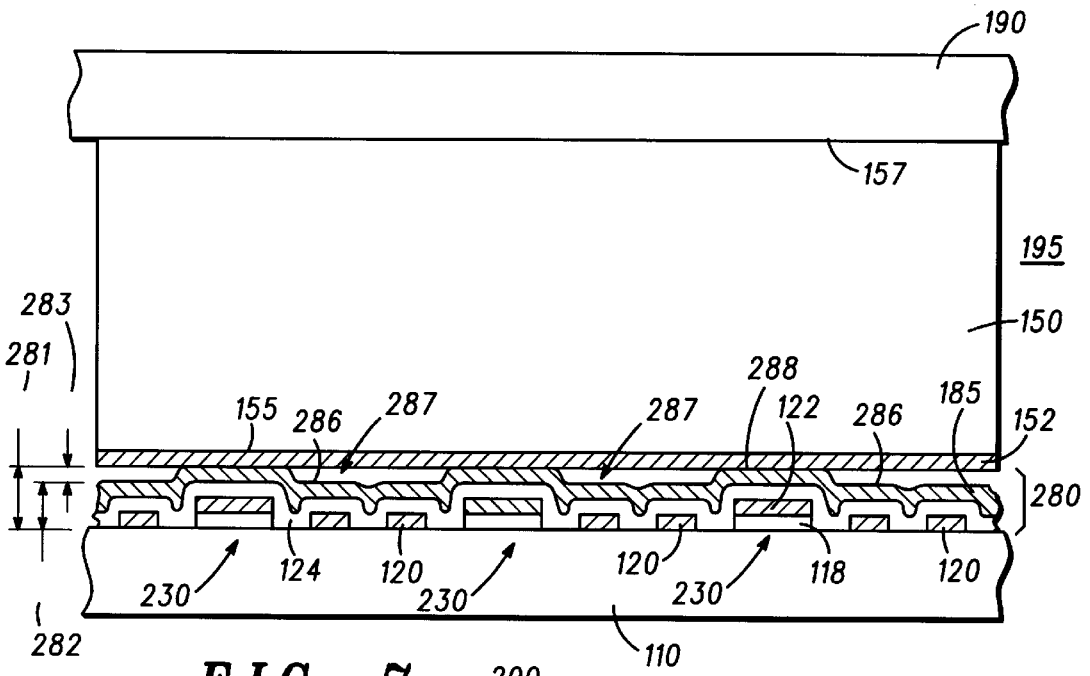
FIG. 7 is a cross-sectional view taken along the section line 7—7 of FIG. 5.

FIGS. 5–7 include views similar to those of FIGS. 1–3, respectively, of a field emission device 200 in accordance with the invention. In the embodiment of FIGS. 5–7 a spacer contact layer 185 is provided that is electrically isolated from and spaced apart from a plurality of gate electrodes 144. Spacer contact layer 185 includes a conductive material which is designed to be connected to a potential source (not shown) for providing a potential thereto. This potential source is distinct from the potential sources connected to gate electrodes 144 and cathodes 120, so that the potential at spacer contact layer 185 can be independently controlled.

FIG. 5 is a top plan view of field emission device 200 and illustrates gate electrodes 144, spacer contact layer 185, and a plurality of spacer pads 230, the top surfaces of which are defined by spacer contact layer 185.

FIG. 6 is a cross-sectional view of field emission device 200 taken along the section line 6—6 of FIG. 5. Spacer contact layer 185 can be formed during the deposition of gate electrodes 144. The material used to form gate electrodes 144 is further patterned to define spacer contact layer 185 and may include molybdenum. Alternatively, an additional step can be employed to form spacer contact layer 185.

FIG. 7 is a cross-sectional view of field emission device 200 taken along the section line 7—7 of FIG. 5. In the embodiment of FIGS. 5–7, spacer contact layer 185 extends continuously along the length of spacer 150, so that spacer contact layer 185 defines a first portion 286 of the surface of a cathode structure 280. A plurality of gaps 287 are defined by conductive layer 152 of spacer 150, first portion 286 of the surface of cathode structure 280, and spacer pads 230. First portion 286 of the surface of cathode structure 280 is defined by spacer contact layer 185 and overlies cathodes 120 along the length of spacer 150.

In the embodiment of FIGS. 5–7 spacer pads 230 include ballast pad layer 118, cathode pad layer 122, a portion of dielectric layer 124, and a portion of spacer contact layer 185, which defines a second portion 288 of the surface of cathode structure 280. Second portion 288 is disposed between cathodes 120. For the embodiment wherein spacer contact layer 185 is formed during the deposition of gate electrodes 144, a second height 281 $h_p$ of cathode structure 280 at spacer pads 230 is computed in the same manner as that described with reference to spacer pads 130 of FIG. 2. A first height 282 $h_c$ of cathode structure 280 at cathodes 120 is defined by the thicknesses of cathodes 120, dielectric layer 124, and spacer contact layer 185, the sum of which is about 15,000 angstroms. In this manner a height 283 $h_g$ of gaps 287 is about 5000 angstroms.

Figure 8:
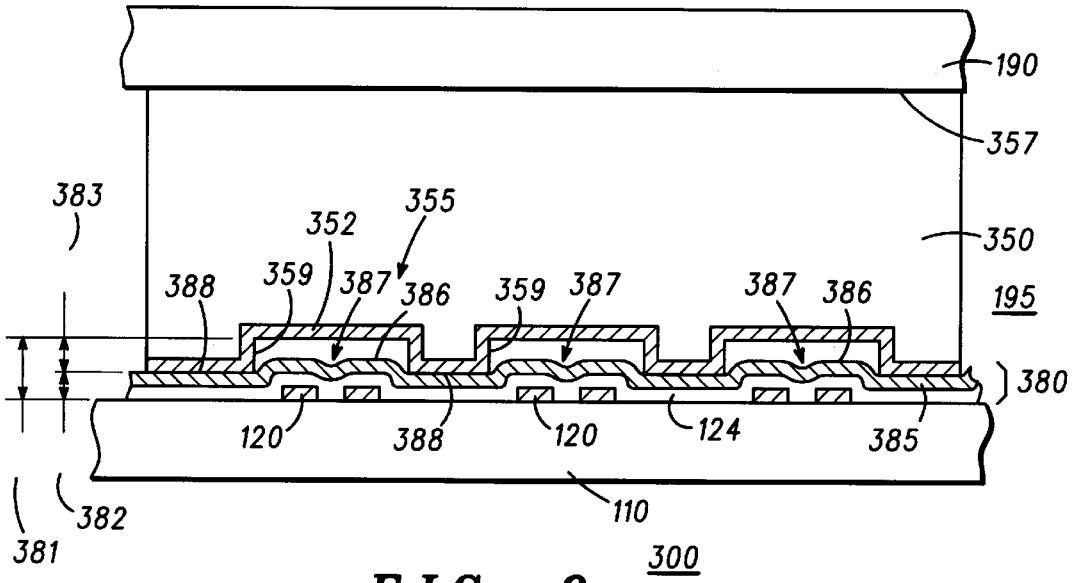
FIG. 8 is a cross-sectional view similar to that of FIGS. 3 and 7 of a third embodiment of a field emission device in accordance with the present invention.

FIG. 8 is a cross-sectional view similar to that of FIGS. 3 and 7 of a field emission device 300 in accordance with the present invention. Field emission device 300 includes a spacer 350, which has a plurality of spacer grooves 359. Spacer grooves 359 are defined by a second edge 355 of spacer 350. A first edge 357 of spacer 350 makes contact with anode 190. Spacer grooves 359 overlie cathodes 120.

Spacer 350 includes a rib of a hard dielectric material, such as a glass. Spacer grooves 359 can be formed by sawing into one of the edges of the rib of the hard dielectric material using a diamond saw.

Field emission device 300 includes a cathode structure 380, which is configured similar to cathode structures 180, 280 of field emission devices 100, 200, respectively, except that it does not include spacer pads. Instead, the regions of cathode structure 380 between cathodes 120 include portions of dielectric layer 124 and portions of a spacer contact layer 385. Spacer contact layer 385 is formed in the manner described with reference to spacer contact layer 185 of FIG. 5. Alternatively, a spacer contact layer, such as spacer contact layer 142 described with reference to FIGS. 1–4, can be employed. A conductive layer 352 is formed on second edge 355 in the manner described with reference to conductive layer 152 of FIGS. 1–7.

A first portion 386 of the surface of cathode structure 380 overlies cathodes 120 along the length of spacer 350 and is defined by spacer contact layer 385; a second portion 388 of the surface of cathode structure 380 is disposed between cathodes 120 along the length of spacer 350 and is also defined by spacer contact layer 385. Conductive layer 352 physically contacts the surface of cathode structure 380 at second portion 388. Spacer grooves 359 and first portion 386 of the surface of cathode structure 380 define a plurality of gaps 387 that overlie cathodes 120. Gaps 387 have a height 383 $h_g$ that is sufficient to prevent contact between second edge 355 of spacer 350 and cathodes 120 during the evacuation of field emission device 300. The maximum height of cathode structure 380 along the length of spacer 350 is equal to a first height 382 $h_c$ of cathode structure 380 at cathodes 120.

Figure 9:
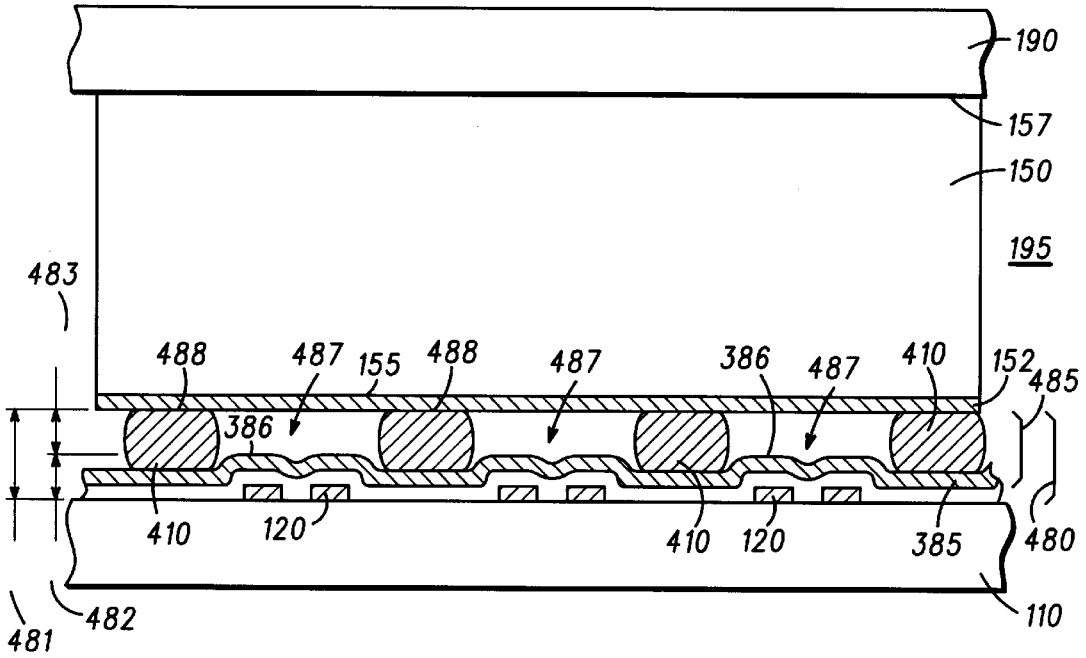
FIG. 9 is a cross-sectional view similar to that of FIG. 8 of a fourth embodiment of a field emission device in accordance with the present invention.

FIG. 9 is a cross-sectional view similar to that of FIG. 8 of a field emission device 400 in accordance with the present invention. In the embodiment of FIG. 9 a cathode structure 480 has a spacer contact layer 485 that further includes a plurality of ball bumps 410. Ball bumps 410 are disposed on spacer contact layer 385 between cathodes 120 and define a second portion 488 of the surface of cathode structure 480. Second portion 488 of the surface of cathode structure 480 is disposed between cathodes 120 along the length of spacer 150. Ball bumps 410 include deposits of a metal, such as gold, aluminum, and the like. Ball bumps 410 are bonded by thermal compression techniques to spacer contact layer 385 and to conductive layer 152 of spacer 150. Further illustrated in FIG. 9, a plurality of gaps 487 are defined by ball bumps 410, conductive layer 152, and first portion 386 of the surface of cathode structure 480. A height 483 of gaps 487 can be controlled by adjusting the size of ball bumps 410. Cathode structure 480 has first height 382 $h_c$ at cathodes 120 along the length of spacer 150. Cathode structure 480 also has a second height 481 $h_p$ at ball bumps 410. Second height 481 is greater than first height 382.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

We claim:

1. A field emission device comprising:

an anode having a major surface;

a substrate having a major surface;

a cathode structure having an electron emitter, a first cathode, a second cathode, and a surface, the first and second cathodes disposed on the major surface of the substrate, the surface of the cathode structure having a first portion overlying the first and second cathodes and a second portion coextensive with the first portion and positioned between the first and second cathodes;

the surface of the cathode structure spaced apart from the major surface of the anode to define an interspace region therebetween;

a spacer disposed in the interspace region and having a first edge and a second edge, the first edge disposed in abutting engagement with the major surface of the anode, the second edge disposed in abutting engagement with the second portion of the surface of the cathode, the electron emitter of the cathode structure spaced apart from the second edge of the spacer; and the second edge of the spacer and the first portion of the surface of the cathode structure defining a first gap overlying the first cathode and a second gap overlying the second cathode whereby the first and second gaps prevent physical and electrical contacts between the second edge of the spacer and the first and second cathodes.

2. The field emission device of claim 1, wherein the spacer further includes first and second spacer grooves defined by the second edge of the spacer, the first spacer groove overlying the first cathode and the second spacer groove overlying the second cathode.

3. The field emission device of claim 1, wherein the cathode structure further includes a ball bump disposed between the first and second cathodes and defining the second portion of the surface of the cathode structure, and wherein the first portion of the surface of the cathode structure has a first height from the major surface of the substrate and the second portion of the surface of the cathode structure has a second height from the major surface of the substrate, the second height being greater than the first height.

4. The field emission device of claim 1, wherein the cathode structure further includes a spacer pad disposed between the first and second cathodes and defining the second portion of the surface of the cathode structure, and wherein the first portion of the surface of the cathode structure has a first height from the major surface of the substrate and the second portion of the surface of the cathode structure has a second height from the major surface of the substrate, the second height being greater than the first height.

5. The field emission device of claim 4, wherein the cathode structure further includes a dielectric layer disposed on the first and second cathodes, and wherein the spacer pad includes a ballast pad layer disposed on the major surface of the substrate, a cathode pad layer disposed on the ballast pad layer, and a portion of the dielectric layer disposed on the cathode pad layer.

6. A field emission device comprising:

an anode having a major surface;

a substrate having a major surface;

a cathode structure having an electron emitter, a first cathode, a second cathode, a spacer contact layer, and a surface, the first and second cathodes disposed on the major surface of the substrate, the surface of the cathode structure having a first portion overlying the first and second cathodes and a second portion coextensive with the first portion and positioned between the first and second cathodes, the second portion of the surface of the cathode structure defined by the spacer contact layer;

the surface of the cathode structure spaced apart from the major surface of the anode to define an interspace region therebetween;

a spacer disposed in the interspace region and having a first edge, a second edge, and a conductive layer disposed on the second edge, the first edge disposed in abutting engagement with the major surface of the anode, the conductive layer disposed in abutting engagement with the spacer contact layer at the second portion of the surface of the cathode structure, the electron emitter of the cathode structure spaced apart from the second edge of the spacer; and the conductive layer of the spacer and the first portion of the surface of the cathode structure defining a first gap overlying the first cathode and a second gap overlying the second cathode whereby the first and second gaps prevent physical and electrical contacts between the conductive layer of the spacer and the first and second cathodes.

7. The field emission device of claim 6, wherein the spacer further includes first and second spacer grooves defined by the second edge of the spacer, the first spacer groove overlying the first cathode and the second spacer groove overlying the second cathode.

8. The field emission device of claim 6, wherein the spacer contact layer further includes a ball bump disposed between the first and second cathodes and defining the second portion of the surface of the cathode structure, and wherein the first portion of the surface of the cathode structure has a first height from the major surface of the substrate and the second portion of the surface of the cathode structure has a second height from the major surface of the substrate, the second height being greater than the first height.

9. The field emission device of claim 6, wherein the cathode structure further includes a spacer pad disposed between the first and second cathodes, the spacer contact layer defining the surface of the spacer pad, and wherein the first portion of the surface of the cathode structure has a first height from the major surface of the substrate and the second portion of the surface of the cathode structure has a second height from the major surface of the substrate, the second height being greater than the first height.

10. The field emission device of claim 9, wherein the cathode structure further includes a dielectric layer disposed on the first and second cathodes, and wherein the spacer pad includes a ballast pad layer disposed on the major surface of the substrate, a cathode pad layer disposed on the ballast pad layer, a portion of the dielectric layer disposed on the cathode pad layer, and the spacer contact layer disposed on the portion of the dielectric layer.

11. The field emission device of claim 6, wherein the cathode structure further includes a gate electrode defining a portion of the surface of the cathode structure and disposed proximate to the electron emitter, the spacer contact layer electrically connected to the gate electrode.

12. The field emission device of claim 11, wherein the spacer contact layer includes a portion of the gate electrode.

13. The field emission device of claim 6, wherein the cathode structure further includes a gate electrode defining a portion of the surface of the cathode structure and disposed proximate to the electron emitter, the spacer contact layer spaced apart from the gate electrode, so that the spacer contact layer is electrically isolated from the gate electrode.

14. A field emission device comprising:

an anode having a major surface;

a substrate having a major surface;

a cathode structure having a first cathode disposed on the major surface of the substrate, a second cathode disposed on the major surface of the substrate and spaced apart from the first cathode, a surface overlying the first and second cathodes, a dielectric layer disposed on the first and second cathodes and spaced apart from the major surface of the anode to define an interspace region therebetween, an electron emitter disposed within the dielectric layer, and a spacer pad disposed on the major surface of the substrate between the first and second cathodes and having a spacer contact layer, the spacer contact layer defining the surface of the spacer pad;

a spacer having a first edge, a second edge, and a conductive layer disposed on the second edge, the first edge disposed in abutting engagement with the major surface of the anode, the conductive layer disposed in abutting engagement only with the spacer pad, the electron emitter spaced apart from the second edge of the spacer; and the conductive layer of the spacer and the surface of the cathode structure defining a gap therebetween at each of the first and second cathodes.

15. The field emission device of claim 14, wherein the spacer pad is electrically isolated from the first and second cathodes.

* * * * *